US005829080A

United States Patent [19]

Robillard et al.

[11] Patent Number: 5,829,080

[45] Date of Patent: Nov. 3, 1998

[54] RECLINER CHAIR HAVING RESILIENT HEAD REST

[76] Inventors: Julie Robillard; Dennis Robillard, both of 38 River Rd., Eliot, Me. 03903

[21] Appl. No.: 892,454

[22] Filed: Jul. 14, 1997

[51] Int. Cl.[6] ..... A47C 17/66

[52] U.S. Cl. ..... 5/638; 5/656; 297/900; 297/391

[58] Field of Search ..... 297/391, 397, 297/900; 5/638, 656, 725

[56] References Cited

U.S. PATENT DOCUMENTS

| | | | |
|---|---|---|---|
| 2,990,558 | 7/1961 | Engel | 5/725 |
| 3,926,181 | 12/1975 | Eischen, Sr. | 5/338 |
| 4,606,086 | 8/1986 | Rowland | 297/900 X |
| 4,779,297 | 10/1988 | Sturges | 5/638 X |
| 4,891,854 | 1/1990 | Funkelstein | 5/638 |
| 5,546,619 | 8/1996 | Braun | 5/638 |
| 5,624,157 | 4/1997 | Kostuk | 297/229 X |
| 5,661,860 | 9/1997 | Heitz | 5/638 X |

*Primary Examiner*—Peter R. Brown
*Attorney, Agent, or Firm*—Frederick R. Cantor, Esq.

[57] ABSTRACT

A recliner chair having a fabric panel for supporting the head of a person reclining on the chair. An annular resilient cushion is placed on the upper surface of the fabric panel to cradle the person's head and distribute the weight of the head onto a relatively large annular surface area of the cushion.

1 Claim, 1 Drawing Sheet

RECLINER CHAIR HAVING RESILIENT HEAD REST

BACKGROUND OF THE PRESENT INVENTION

SUMMARY OF THE PRESENT INVENTION

This invention relates to a recliner chair having a resilient head rest adapted to cushionably cradle the head of a person reclining on the chair. The recliner chair can be a conventional folding lawn chair. The resilient head rest can be incorporated as an integral component of the chair. Alternately, the resilient head rest can be a separate structure capable of add-on attachment to an existing recliner chair.

Lawn chairs of the recliner type typically comprise an articulated frame structure that includes a central frame section, a head section foldable or unfoldable at one end of the central frame section, and a foot section foldable or unfoldable at the other end of the central frame section. The articulated frame structure supports a fabric panel system that provides the supporting surfaces for the person's body. Foldable leg structures are located at opposite ends of the central frame section to support the chair at a suitable elevation above the ground surface.

In use of the recliner lawn chair the person lies on the chair fabric panel, with his/her head resting against the head section fabric, and with his/her lower legs lying against the foot section fabric. The overall length of the chair is usually six or more feet, such that the person's entire body can usually be accommodated on the chair. The head section of the chair is usually adjustable around its pivot connection with the central section, whereby the head section can be adjusted between a prone position level with the chair central section and an upwardly tilted condition angled up to an angle of thirty or forty degrees.

The chair occupant can assume various positions on the recliner chair, e.g. lying on his/her side, back or stomach. In any of the three positions, the person's head rests against a relatively still, non-yielding fabric surface. The weight of the head on the non-yielding fabric is relatively uncomfortable.

The present invention is concerned with a relatively soft resilient cushion positionable in a fixed location on the fabric panel of the recliner chair to cradle the head of the person lying on the chair. The resilient cushion has an annular configuration so that the person's head is cradled within the central space circumscribed by the resilient annulus.

The annular configuration of the resilient cushion is advantageous in that the annular surface provides a relatively large surface area in contact with the person's head. This reduces the unit area pressure on the person's head, thereby contributing to a more comfortable feeling.

In preferred practice of the invention a hole is formed in the chair fabric panel to align with the central space circumscribed by the annular cushion. The hole provides a clearance space for the portion of the person's head located within the cushion. For example, when a person is lying on his back the central rear portion of his/her head can protrude downwardly through the central space within the cushion and possibly through the aligned hole in the fabric panel, such that the weight of the person's head is borne entirely by the resilient cushion. The head can sink into the soft cushion so as to achieve a relatively low unit area pressure on the head surface.

In preferred practice of the invention the annular resilient cushion is an integral part of the recliner chair, as it comes out of the factory. However, in extended application of the invention the annular resilient cushion can be a separate construction usable on a range of different pre-existing lawn chairs. The separate annular cushion can be attached to the fabric panel of the lawn chair by various attachment mechanisms, e.g. contact adhesive or screw type fasteners.

Specific features and advantages of the invention will be apparent from the attached drawings and description of the preferred embodiments of the invention.

In summary, and in accordance with the above discussion, the foregoing objectives are achieved in the following embodiments.

1. A recliner chair having a fabric panel adapted to support the head of a person reclining on the chair; and an annular resilient cushion facing upwardly on said fabric panel to cradle the person's head.
2. The recliner chair, as described in paragraph 1, and further comprising an opening in said fabric panel aligned with the space circumscribed by said annular resilient cushion.
3. The recliner chair, as described in paragraph 1, wherein said annular resilient cushion comprises an annular resilient foam core and a cloth covering on said foam core.
4. The recliner chair, as described in paragraph 1, wherein said annular resilient cushion has an inner oval surface conforming approximately to the contour of a person's head.
5. The recliner chair, as described in paragraph 1, wherein said fabric panel has an upper edge and a central axis extending normal to said upper edge;
   said annular resilient cushion having a longitudinal axis coincident with said central axis, and a transverse axis normal to said longitudinal axis, and
   said annular resilient cushion circumscribing a central space that has a relatively large dimension along the longitudinal axis, and a relatively small dimension along the transverse axis.
6. The recliner chair, as described in paragraph 5, wherein said central space has an oval shape.
7. The recliner chair, as described in paragraph 5, wherein said annular resilient cushion has an endless inner edge defining said central space; and said inner edge having a convex arcuate cross section.

BRIEF DESCRIPTION OF THE DRAWINGS

FIG. 2 is taken in the direction of arrow 2 in FIG. 1.

DESCRIPTION OF THE PREFERRED EMBODIMENTS OF THE PRESENT INVENTION

Figure 1:
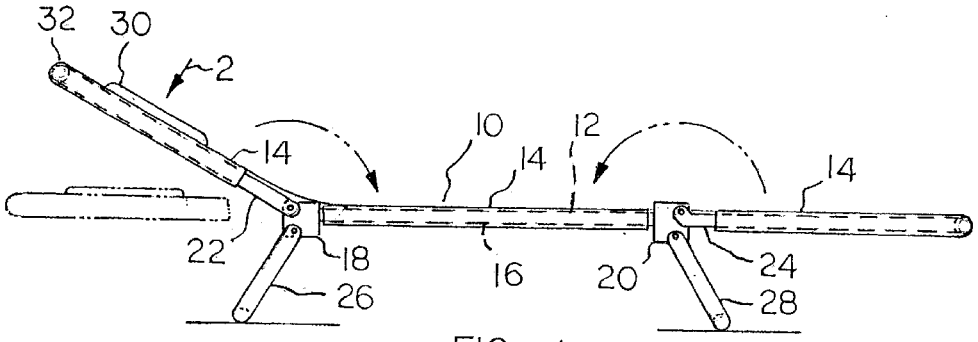
FIG. 1, is a side elevational view, of a recliner lawn chair embodying the invention.

FIG. 1, is a side elevational view, of a recliner lawn chair embodying the invention.

Referring to FIG. 1, there is shown a recliner lawn chair 10 that includes an articulated frame structure 12 supporting a fabric panel 14. Frame structure 12 comprises a central rectangular frame section 16 having a first pair of brackets 18 at one end, and a second pair of brackets 20 at its other end. A rectangular head frame section 22 is pivotally connected to brackets 18, and a rectangular foot frame section 24 is pivotally connected to brackets 20.

The frame sections 22 and 24, together with the associated fabric panel areas, can be folded onto the central frame section 16, as shown by the arcuate arrows in FIG. 1, e.g. when it is desired to store the chair or move the chair from one location to another location.

Central frame section 16 is supported above the ground surface by foldable legs 26 pivotally attached to brackets 18 and foldable legs 28 pivotally attached to brackets 20.

Fabric panel 14 extends the entire length and width of the articulated frame structure 12. Edge areas of the fabric panel are attached to the frame sections, e.g. by curling edge areas of the panel around the frame section surfaces. The frame sections can be formed of aluminum tubing. The fabric panel can be formed of canvas or a heavy weight woven nylon fabric of sufficient strength to support the weight of a person lying on the chair. The chair typically has a length in excess of six feet and a width of about two feet.

Head frame section 22 is adjustably connected to brackets 18 so as to be set at various inclinations, as shown in the dashed lines in FIG. 1. The angle of adjustment is a matter of individual preference. When the head frame section is in a prone position level with the central frame section 16 the person has a choice of positions, e.g. lying on his/her stomach with the face facing downwardly, or lying on his/her side, or lying on his/her back with the face facing upwardly.

The present invention is concerned particularly with an annular resilient cushion 30 mounted on the upper surface of fabric panel 14 to cushionably cradle the head of a person lying on the fabric panel. The cushion is located near the upper end edge 32 of the fabric panel 14 on the panel longitudinal axis, i.e. midway between the side edges of the recliner chair.

Figure 2:
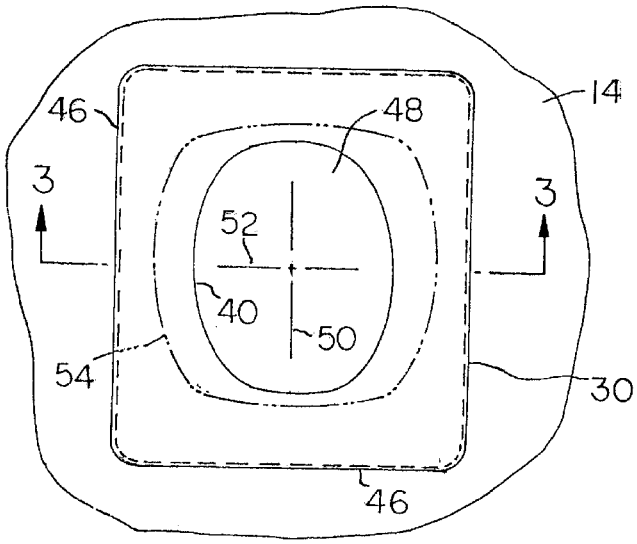
FIG. 2, is a plan view, of a resilient annular cushion used the FIG. 1 lawn chair.

FIG. 2, is a plan view, of a resilient annular cushion used in the FIG. 1 lawn chair. FIG. 2 is taken in the direction of arrow 2 in FIG. 1.

Figure 3:
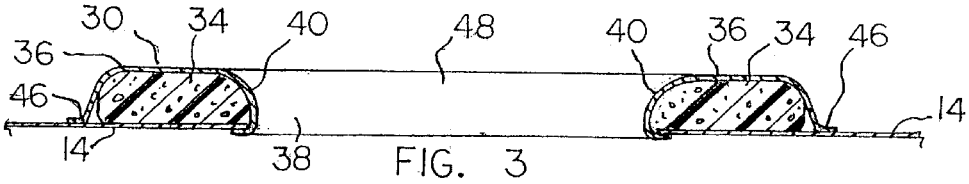
FIG. 3, is an enlarged cross sectional view, taken on line 3—3 in FIG. 2.

FIG. 3, is an enlarged cross sectional view, taken on line 3—3 in FIG. 2.

Figure 4:
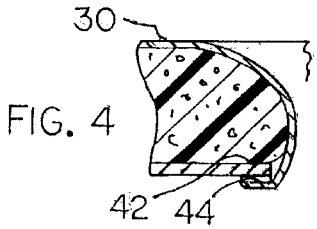
FIG. 4, is a fragmentary sectional view, illustrating a stitched connection used to connect the resilient annular cushion of FIG. 3 to the lawn chair fabric panel.

FIG. 4, is a fragmentary sectional view, illustrating a stitched connection used to connect the resilient annular cushion of FIG. 3 to the lawn chair fabric panel.

The structure of annular cushion 30 is shown particularly in FIGS. 2 and 3. The cushion comprises a resilient preformed annular core 34 and a fabric covering 36 overlying the otherwise exposed surface of the resilient core 34.

Resilient core 34 can be formed of various resilient materials or material combinations, e.g. a soft elastomeric foam or a fibrous cotton batten material having a predetermined shape. The core material preferably has a memory, so that when the person removes his/her head from the cushion the core material resiliently returns to its original shape.

Fabric panel 14 has a central hole 38 having the same shape as the space circumscribed by the inner annular surface 40 of the cushion. Covering 36 is stitched to the edge area 42 of panel 14 defined by central hole 38. During the manufacturing process, covering 36 may be stitched to panel 14 prior to placement of resilient annular core 34 on the panel 14 surface. With covering 36 disposed on the undersurface of panel 14 the inner edge area 44 of the covering can be stitched to edge area 42 of panel 14, after which the covering can be pulled upwardly through the hole 38 in panel 14. The seam is thus concealed and removed from areas of the cushion likely to come in contact with the person's head.

Resilient annular core 34 can be placed on panel 14, and the outer edge area of covering 36 can then be stitched to panel 14, as at 46. During this stitching operation resilient core 34 can be slightly compressed to achieve a tight fit of the covering on the resilient core.

The annular resilient cushion is configured so that the central space 48 within the cushion has a generally oval configuration, as shown in FIG. 2. The dimension of central space 48 along longitudinal axis 50 can be about five and one-half inch; the dimension of central space 48 along the transverse axis 52 can be about three and one-half inch. Depending on the resilience of the core 34 material, the cushion can have a thickness of approximately one inch to two inches.

The upper surface of the cushion is essentially flat. Inner annular edge surface 40 of the cushion has a convex arcuate cross section as viewed in FIG. 3. When a person of average head size rests the back of his/her head against the cushion the pressure of the head against the cushion is absorbed generally by the cushion surface circumscribed by imaginary dashed line 54, shown in FIG. 2. This cushion area has a generally convex arcuate cross section, as shown in FIG. 3, whereby the cushion surface is deformable and generally conformable to the contour of the human head surface. The central rounded area of the person's head protrudes into the cushion central space 48.

When a person of average head size rests the side of his/her head against the cushion the cheekbone and a portion of the person's eye aligns with the cushion central space 48. The cushion resiliently engages the person's forehead (temple area), ear and chin.

When a person of average head size rests his/her face area against the cushion, the cushion engages the forehead, chin and temple areas of the person's face; the eyes, nose and mouth are located within the central vacant space 48.

The annular configuration of the resilient annular cushion 30 provides a relatively large annular support surface engageable with the person's head, thus contributing to low unit area pressures on the head surfaces. Pressure is relieved from central areas of the person's head. Also, the head tends to be cradled within the cushion, so as to remain stable; the person does not have to make a conscious effort to keep his/her head on the cushion.

Figure 5:
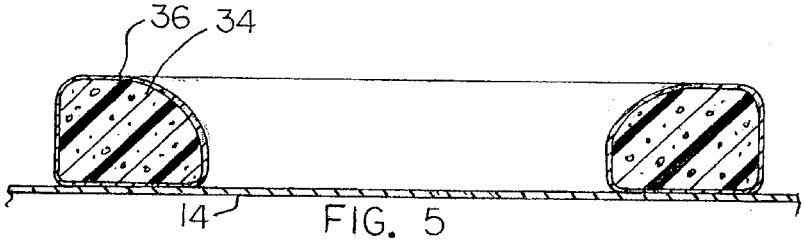
FIG. 5, is a sectional view, taken in the same direction as FIG. 3, but showing another form of the invention.

FIG. 5, is a sectional view, taken in the same direction as FIG. 3, but showing another form of the invention.

FIG. 5 shows an alternate form that the annular cushion can take. In this case the resilient annular core 34 is encased within a fabric covering 36 prior to placement of the annular cushion on fabric panel 14. The annular cushion 30 can be secured to fabric panel 14 by means of a contact adhesive applied to the lower flat surface of the cushion; other connecting mechanisms can be used. The cushion can have various locations on fabric panel 14, according to individual preference. The cushion can be marketed separately from the recliner chair, such that the cushion can be used on preexisting recliner chairs.

The drawings show specific forms of the invention. However, it will be appreciated that the invention can be embodied in various forms and configurations.

The present invention, described above, relates to a recliner chair having resilient head rest. Features of the present invention are recited in the appended claims. The drawings contained herein necessarily depict structural features and embodiments of the recliner chair having resilient head rest, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed:

1. A recliner chair having a fabric panel adapted to support the head of a person reclining on the chair in a face-up position; and an annular resilient cushion facing upwardly on said fabric panel to cradle the person's head;

said fabric panel having an oval shaped hole (38) therein; said resilient cushion having an inner oval surface (40) of the same size and shape as said oval-shaped hole;

said fabric panel having an upper surface and a lower surface; said annular resilient cushion being positioned on the panel upper surface, with the inner oval surface of the cushion aligned with the oval-shaped hole in the panel;

the inner oval surface of the cushion having a convex arcuate cross section; and said resilient cushion being supported on the panel surface so that the cushion is located entirely above said panel, whereby the head of the person resting against the cushion in a face-up position projects only a minimal distance into said oval-shaped hole.

* * * * *